US006763847B2

(12) United States Patent
Jou

(10) Patent No.: US 6,763,847 B2
(45) Date of Patent: Jul. 20, 2004

(54) AIRLESS OIL HEADER

(76) Inventor: Wuu-Cheau Jou, No. 497-6, Tsao Hu Road, Da Li City, Taichung Hsien (TW)

( * ) Notice: Subject to any disclaimer, the term of this patent is extended or adjusted under 35 U.S.C. 154(b) by 0 days.

(21) Appl. No.: 10/061,106

(22) Filed: Feb. 1, 2002

(65) Prior Publication Data

US 2003/0145887 A1 Aug. 7, 2003

(51) Int. Cl.[7] ..... F04F 3/00
(52) U.S. Cl. ..... 137/205; 184/1.5
(58) Field of Search ..... 137/205; 184/1.5

(56) References Cited

U.S. PATENT DOCUMENTS 1,986,476 A * 1/1935 Ironside ..... 184/1.5
2,682,886 A * 7/1954 Paxton ..... 137/205
5,427,505 A * 6/1995 Payne ..... 137/205
6,412,669 B1 * 7/2002 Chuang ..... 137/205
6,558,138 B2 * 5/2003 Tseng ..... 137/205

* cited by examiner

*Primary Examiner*—Gerald A. Michalsky
(74) *Attorney, Agent, or Firm*—Charles E. Baxley

(57) ABSTRACT

An oil airless sucking machine that has features of easy control, smaller volume for carrying, and is suited to any size oil container. The machine has a three-way T-shaped nozzle carrier, which has a radial valve through-hole built as a valve buckle for a control valve cock fitting so as to construct a control valve. A non-home switch handle snaps on long tenons of the valve cock for spinning together, and by means of a friction force between a couple of O-rings located approaching both ends of the valve cock and the valve buckle, the non-home switch can be kept in any position for cut-in or off processes without needing to be held all the time during running. The dividable joint structure of the cap and the nozzle carrier makes changing different size oil tanks for working on different gear boxes easy.

2 Claims, 5 Drawing Sheets

AIRLESS OIL HEADER

BACKGROUND OF THE INVENTION

1. Field of the Invention

The present invention relates to an airless oil header, and more particularly to an oil airless sucking machine that has a small volume for carrying, can suit any size oil container, and has a non-home switch that does not have to be held all the time when running.

2. Description of Prior Art

In common vehicles, trains, various machines, and mechanical equipments, gear boxes thereof need to use lubricant for lubrication, but after a certain period of time of running or a certain distance (km or mile), to keep the lubrication function in an efficient state the lubricant has to be replaced. In general, the users should use a professional oil header driven by a vacuum-pump generating vacuum sucking force to suck up waste oil. But this kind of oil header is very expensive, hence an airless oil header employing a vacuum suction force created by compressed air jet flow came out.

As shown in FIG. 1, a conventional airless oil header 10 is comprised of a blowgun 11, a nozzle carrier 12 combined on a blowpipe 111, an oil tank 13 attached on a bottom side of the nozzle carrier 12 via a cap 14 so that a vacuum suction force generated by compressed air jet flow blown out from a nozzle 121 inside of the nozzle carrier 12 at a high speed creates a suction force in the oil collection tank 13, and a suction pipe 15 crosses inside of the gear box over the oil collection tank 13. Because the specific weight of oil is greater than that of air, waste oil will be dropped into the oil collection tank 13. Meanwhile, air is absorbed into the inside of the nozzle carrier and winded out via a muffle 16 by a high speed jet flow of compressed air with lower noise, thereby keeping collection waste oil of the gear box in the oil collection tank 13 by suction until it is filled up and taken away.

The above-mentioned airless oil header, by means of the vacuum suction force generated by the high speed jet flow of compressed air, has a great suction effect in practice. Whatever structure and cost comparing with that of the pump oil header, it is bound to suit various factories and common families, but there are some demerits existing in structure design and facility as following:

1. During suction process the operator has to hold a lever latch 112 of the blowgun 11 down to keep the compressed air jet flow in a blowing state, so one hand is occupied by this, and the suction pipe 15 has to be held for adjusting position along with a change in level of oil in the gear box, therefore the operator will be convenienced.

2. The nozzle carrier 12 and the cap 14 are fixed in an integrated structure, so the cap 14 cannot be replaced so that the size of the oil tank is limited. In sucking a large volume of oil, an operator has to interrupt the suction process to turn over the waste oil as the oil tank 13 is filled up. Depending on the volume of oil contained in the gear box, the number of interruptions is changed, wasting time and labor.

OBJECTS AND SUMMARY OF THE INVENTION

It is therefore a main object of the present invention to provide an airless oil header, which can be operated easily, just needs one action to cut in or off a non-home switch to control the compressed air jet flow.

Another object of the present invention is to provide an airless oil header that is suited for replacing a variety of different sized oil containers.

DETAILED DESCRIPTION OF PREFERRED EMBODIMENTS

Figure 1:
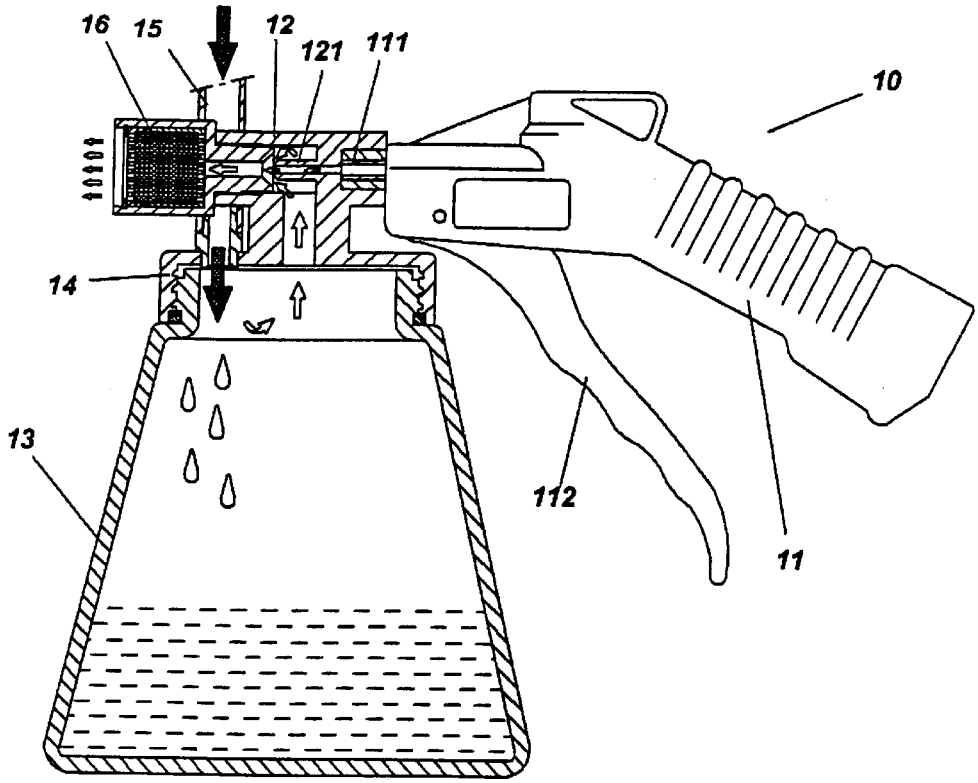
FIG. 1 PRIOR ART
FIG. 1 is a diagrammatic side view of a conventional prior art airless oil header.
Figure 2:
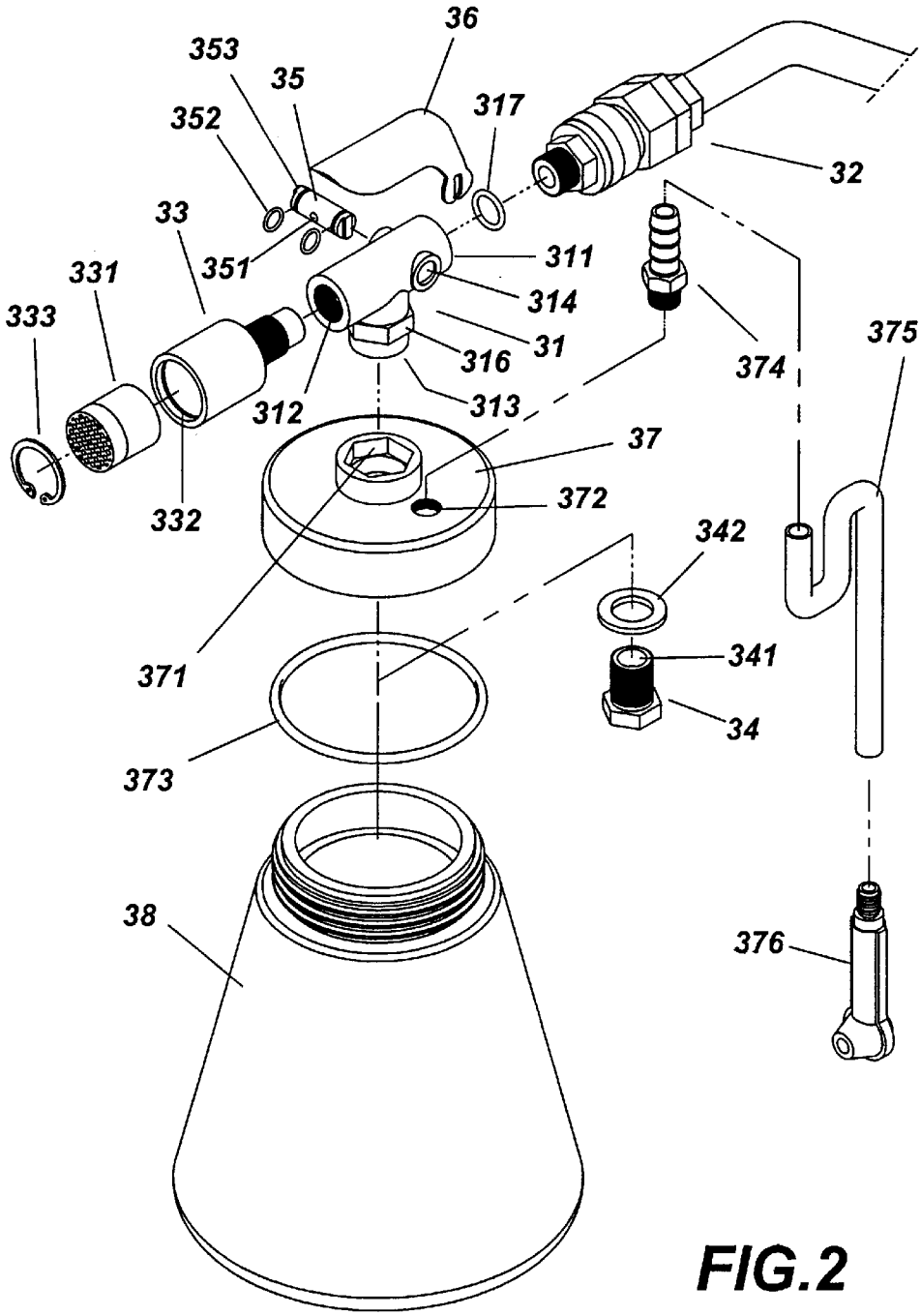
FIG. 2 is an exploded diagrammatic view of the present invention.
Figure 3:
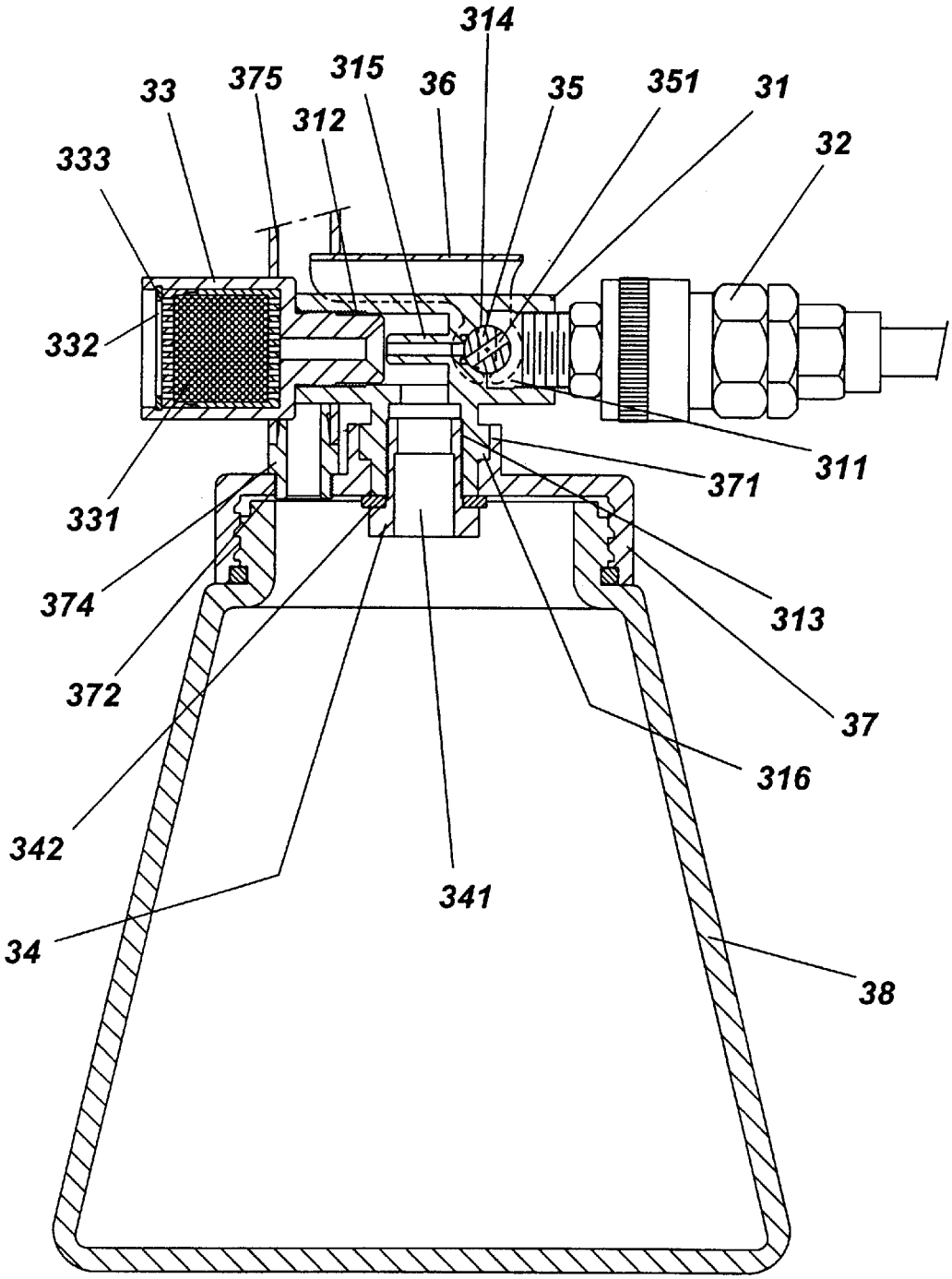
FIG. 3 is a diagrammatic cross-sectional view of the present invention.

Referring to FIG. 2 and FIG. 3, the present invention is comprised of a three-way T-shaped nozzle carrier 31 having three tap holes 311, 312 and 313 for separately securing to a rapid combined connection 32, a muffle seat 33, and a combined fastening bolt 34, and in which a radial valve through-hole 314 is built as a valve buckle for a control valve cock 35.

The control valve cock 35 has a crossing valve opening 351, and is sealed at both ends by two O-rings 352, respectively. Two tenons 353 extend out from both ends of the control valve cock 35, respectively, so that a non-home switch handle 36 clips on both ends thereof by inserting the tenons 353 into slots having elastic openings at ends of the non-home switch handle 36, respectively. The O-rings 352 are set on both sides of the non-home switch handle 36 for spinning therewith. Coordinating to the control valve cock 35, the nozzle carrier 31 has a nozzle 315 with a fine hole extending forward at the inside stretching over the vertical tap hole 313. For preventing the connection portion of the control valve cock 35 and the valve opening 315 from leaking an O-ring 317 is set around a nose end of the valve opening 314. At a bottom side, around the vertical tap hole 313 of the nozzle carrier 31, a polygon connector 316 is built for joining into a polygon hole 371 built on atop end of the cap 37, and they are fastened by securing the combined fastening bolt 34 with a through-hole 341 and a washer 342 into the vertical tap hole 313. Meanwhile the cap 37 can be secured on a top end of a coordinating oil tank 38 and sealed by setting an O-ring 373 between them. The cap 37 has a tap inlet 372 on a top surface for securing a pipe connection 374 holding a flex cable 375 in a proper length. A sucker 376 is fastened on the other end of the cable 375 for stretching into an inside of the gear box. A muffle 331 is held on an inside of the muffle seat 33 by locating a snap ring 333 into an internal ring groove 332.

Figure 4:
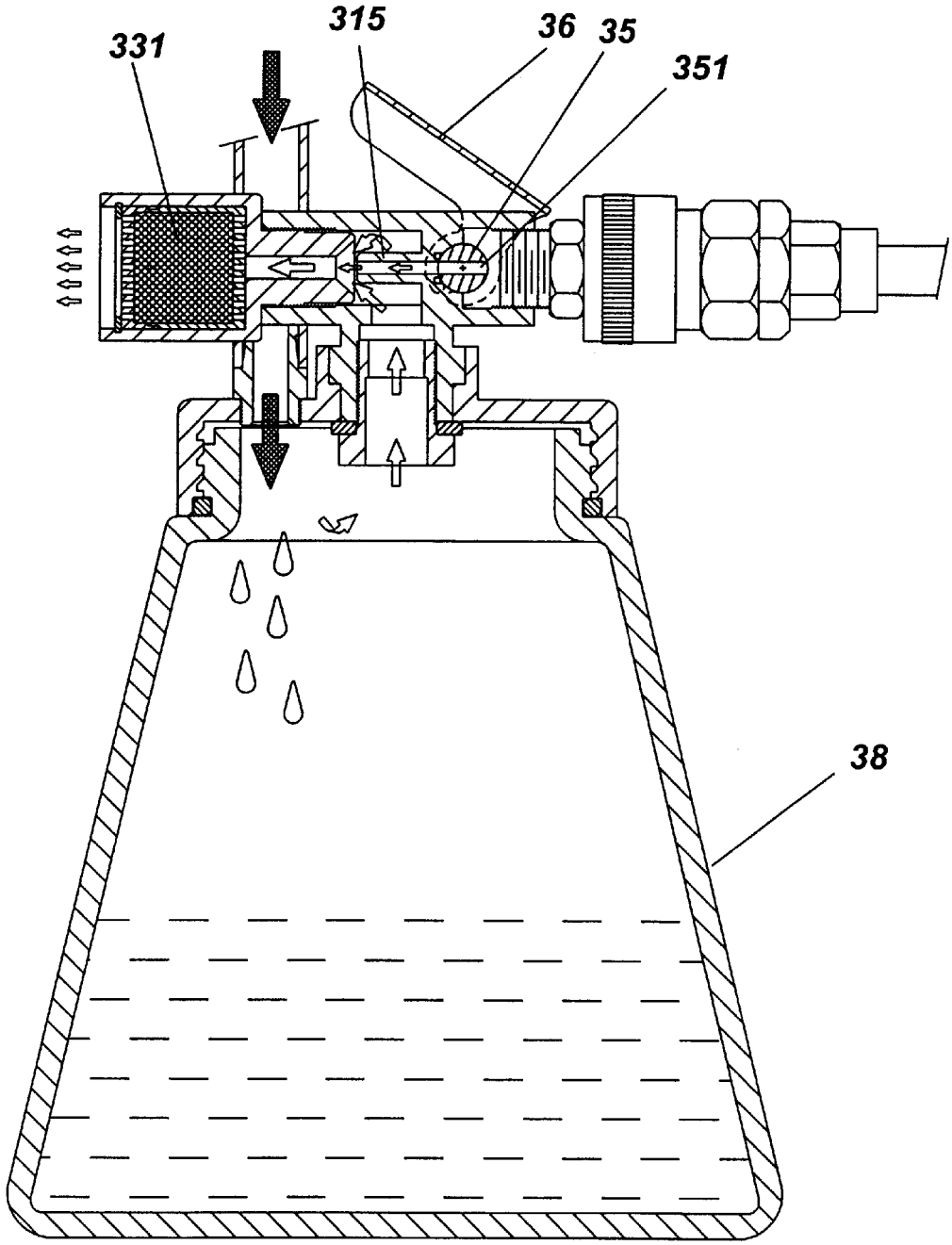
FIG. 4 is a diagrammatic cross-sectional view showing a non-home switch placed and located in a cut-in state of the present invention.

According to the above-mentioned mechanical structural features of the present invention, the details of the structural functions and advanced progresses will be described as follows:

1. The non-home switch's action—cutting in or off:

As shown in FIG. 3, when the non-home switch handle 36 is placed in a cut-off state, the crossing valve opening 351 is blocked from connecting to the nozzle 315, so the control valve cock 35 is in a closed state, and is sealed from both ends and located in any position by the friction forces of the two O-rings 352 and the valve through-hole 314. When it is wanted to lead in the compressed air, turn the switch handle 36 clockwise (as shown in FIG. 4) to lug the valve cock 35 to spin an angle until the valve opening 351 aligns with the nozzle 315 so as to make the compressed air jet come out from the nozzle 315 to the muffle 331 at high speed, simultaneously to generate a vacuum suction force in the inside of the oil tank 38 so that the waste oil in the gear box is sucked into the oil tank 38 via the sucker 376 and the air is drained out through the muffle 331 by reducing noise and speed. Meanwhile keeping a proper suction force in the oil tank lets the oil drop into the bottom of the tank and the air sucked out from a hollow space of the oil tank 38 to perform an oil-air separation function until the oil collection tank 38 is filled up or the waste oil in the gear box is drained away. The switch handle 36 is then pressed down to stop the suction process. The switch handle 36 can be located at any angle whatever in cut-in and cut-off, or any positions between them by a friction force created between the O-rings 352 and the valve buckle 314 so that an operator can control the valve cock 35 cut-in of compressed air to carry out the suction process or cut off without having to hold the switch handle 36 during the process. The operator does not need to draw attention to the switch handle 36, but just on adjusting the position in the gear box, therefore the operation becomes more facilitated.

Figure 5:
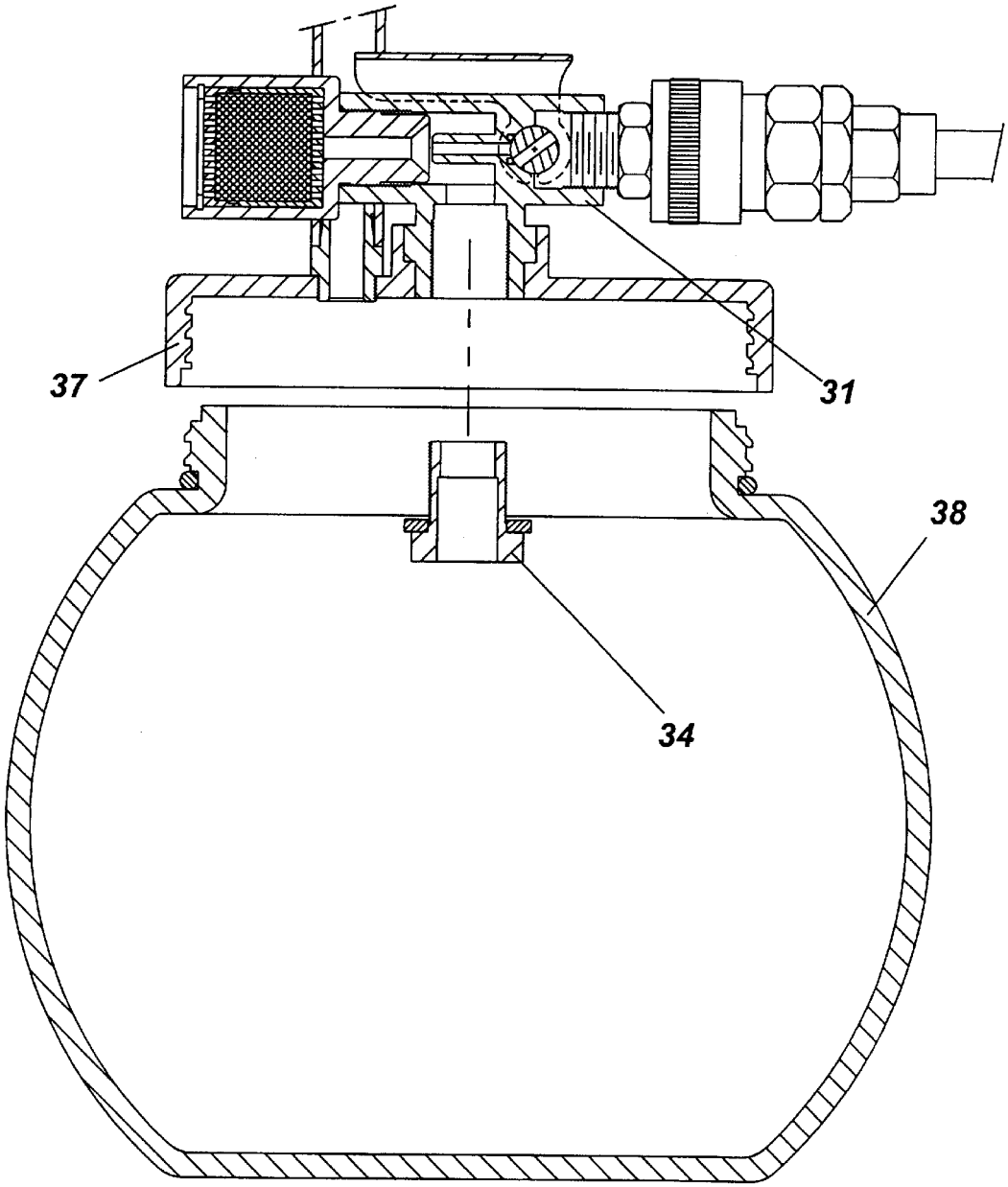
FIG. 5 is a diagrammatic cross-sectional view showing the joint with a changeable oil tank of the present invention.

2. Suiting to various sized oil containers:

Referring to FIG. 2 and FIG. 3, due to a dividable joint structure between the cap 37 and the nozzle carrier 31, the cap 37 can be replaced with other different sized caps 37 for attaching to various volume oil tanks 38. As shown in FIG. 5, by screwing off the combined fastening bolt 34 to remove the cap 37 from the nozzle carrier 31, and then placing on a desired sized cap 37 for joining to different sized oil tanks 38 so as to suit different gear boxes containing various volumes of oil without needing to buy a new set of oil headers having different sucking oil volumes, it not only saves money for the users, but also facilitates operation by replacing oil tanks rapidly, and has more practicability.

Therefore, according to the above-described, we find that the present invention has overcome all the demerits of the conventional airless oil header. For example, to operate one does not need to hold down the control handle, which can be located in any position in the present invention so as to make the cut-in or off processes easier and rapider, and the dividable joint structure of the cap and the nozzle carrier makes changing different size oil tanks to suit working on different gear boxes easy. In addition, the switch handle and the control valve of the present invention are combined into the nozzle carrier directly, changing the conventional joint structure of the blowgun and the airless nozzle carrier to make the structure simpler and smaller with lower production cost.

I claim:

1. An airless oil header comprised of a three-way T-shaped nozzle carrier having three tap holes for separately securing to a rapid combined connection, a muffle seat and a combined fastening bolt, in which a radial valve through-hole is built as a valve buckle for a control valve cock fitting in, and said control valve cock has a crossing valve opening, and is sealed the both ends by two O-rings separately, and two tenons separately built upon the both ends extended out from the both ends of said nozzle carrier so that a non-home switch handle clips from the both ends for spinning together; coordinating to the control valve cock, said nozzle carrier has a nozzle with a fine hole extending forward at the inside stretching over said vertical tap hole; for preventing the connection portion of said control valve cock and the valve opening from leaking an O-ring is set surround the nose end of said valve opening; at the bottom side around the vertical tap hole of said nozzle carrier, a polygon connector is built on for joining into a polygon hole built on the top end of the cap, and they are fastened by securing the combined fastening bolt with a through-hole and a washer on the vertical tap hole, meanwhile said cap can be secured on the top end of a coordinating oil tank, and sealed by setting an O-ring between them, and said cap has a tap inlet built on the top surface for securing a pipe connection holding a flex cable in a proper length at the back end, and a sucker is fastened on the another end of said cable for stretching into the inside of the gear box; a muffle is held on the inside of said muffle seat by locating a snap ring into a internal ring groove.

2. An airless oil header as claimed in claim 1, wherein said non-home switch handle has a pair of slots having an elastic opening at the end individually on the catch set on the both sides for catching the tenons of said valve cock into moving together.

* * * * *